United States Patent [19]

Ojanperä

[11] Patent Number: 4,510,975

[45] Date of Patent: Apr. 16, 1985

[54] WOVEN FRINGED TEXTILE PRODUCT AND A METHOD FOR MAKING SAID MANUFACTURING PRODUCT

[76] Inventor: Heimo K. Ojanperä, Kp 5, 62900 Alajärvi, Finland

[21] Appl. No.: 480,708

[22] Filed: Mar. 31, 1983

[30] Foreign Application Priority Data

Apr. 5, 1982 [FI] Finland ..... 821190

[51] Int. Cl.[3] ..... D03D 3/00

[52] U.S. Cl. ..... 139/384 R; 139/385; 139/415; 112/409; 112/423; 428/193

[58] Field of Search ..... 139/383 R, 384 R, 385, 139/415, 383 AA, 384; 428/192, 193; 112/409, 423, 424, 425, 410

[56] References Cited

U.S. PATENT DOCUMENTS 462,641 11/1891 Henderson ..... 112/423 X
610,742 9/1898 Hardwick ..... 139/415
859,129 7/1907 Smith ..... 139/384 R
1,394,869 10/1921 Stroud, Jr. ..... 139/384 R
4,244,084 1/1981 Gisbourne ..... 139/383 A

*Primary Examiner*—James Kee Chi
*Attorney, Agent, or Firm*—Frost & Jacobs

[57] ABSTRACT

This invention relates to a woven textile product, such as a mat, and a method for manufacturing said product. The product is in the center provided with a layer which is formed by supporting warp threads and on both sides of which are provided weft threads which are bound to each other by means of binding warp threads crossing the layer of supporting warp threads. The product can in a simple manner be provided with fringes by dividing the binding or supporting warp threads in the edge area of the product into two groups, by means of which two adjoining edge strips are formed between which the warp threads not used in the edge strips project as fringes.

2 Claims, 6 Drawing Figures

WOVEN FRINGED TEXTILE PRODUCT AND A METHOD FOR MAKING SAID MANUFACTURING PRODUCT

This invention relates to a woven textile product, such as a mat, having fringes a woven textile product having fringes on the edges and, on each side of a plane defined by supporting warp threads, weft threads which are bound to each other by means of binding warp threads crossing said plane edges of the product being provided with two adjoining edge strips which are folded over to form a selvedge.

Various textile for interior decoration purposes, such as mats and tablecloths, in which the weft threads are located on each side of a plane defined by supporting warp threads, are previously known. For example, hair yarn mats often have such a structure. The warp threads must be terminated in some manner at the ends of the mat, and this takes place in general in two different manners, viz. by forming a selvedge or by binding the warps into fringes. The product is provided with fringes by binding the warp threads extending outside the edge area in groups of a few warp threads into knots which prevent unravelling of the mat. Alternatively, a trimming ribbon provided with fringes or any other suitable ornament such as lace can be secured to the selvedge.

The fitting of the product with fringes involves some disadvantages. Thus, the binding of the warp threads into knots must be carried out manually, which slows up the production. If, on the other hand, a trimming ribbon is secured to the selvedge, the appearance of that side will suffer on which the ribbon is secured so that the possibility of turning the product over is lost.

The U.S. Pat. No. 2,672,168 discloses a woven endless belt having on its longitudinal edges two adjoining edge strips which are formed so that a part of the warp threads bind the weft threads located on one side of the basic plane to each other and another part of the warp threads binds the weft threads located on the opposite side of said plane to each other. In addition, this specification describes the folding over of the edge strip to form a selvedge.

The object of this invention is to provide a fringed textile product which can be manufactured in less time than corresponding known products and in which the different sides have the same appearance. The textile product according to the invention is characterized in that said edge in the edge area of the product, a part of the supporting and binding warp threads binds the weft threads on one side of said plane defined by the supporting warp threads to each other and the remainder of the warp threads of the same kind binds the weft threads on the opposite side of said plane to each other the warp threads not included in said edge strips extending between said edge strips beyond said selvedge as fringes. The fringes formed of warp threads need not be bound into knots but they can extend in a straight condition between the edge strips to the outside of the product because they are fastened between the edge strips. The manual binding of the fringes is thus entirely avoided. Either supporting warp threads or binding warp threads can be used as fringes.

In addition to the fact that the fringes in a way are formed automatically, which shortens the manufacturing time of the product, the omission of the knots results in a longer life of the product because thick knots in general are rapidly worn. Due to the straight fringes also thicker threads than before can be used as warp threads, whereby the number of weft threads is reduced and the manufacturing time of the product is in a corresponding manner shortened. To make a knot of a thick warp thread is difficult, and the large knot produced thereby has a disadvantageous appearance and is rapidly worn.

The invention also relates to a method for manufacturing a fringed woven textile product, such as a mat, according to which method on each side of a plane defined by straight supporting warp threads are positioned weft threads which are bound together by means of binding warp threads crossing said plane and edges of the product are provided with two adjoining edge strips which are folded over to form a selvedge. The method is characterized in that for forming said edge strips, the weft threads located on one side of said plane defined by supporting warp threads are bound to each other by means of a part of said supporting or binding warp threads and the weft threads located on the opposite side of said plane are bound to each other by means of other warp threads of the same kind and the warp threads not included in said edge strips are made to extend between said are cut off edge strips to the outside of said selvedge to form the fringes.

In the following the invention will be described in more detail with reference to the accompanying drawing, in which FIG. 1 is a section of an edge of the textile product according to the invention before folding over the edge strips, FIG. 2 shows a structure drawing of the product of FIG. 1

Figure 1:
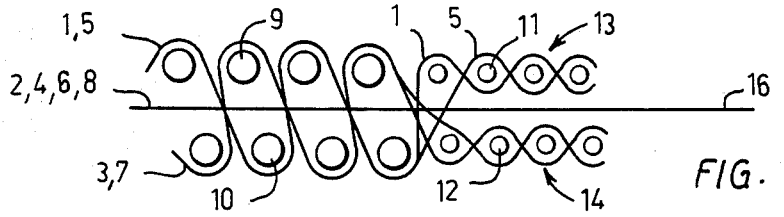
Figure 2:
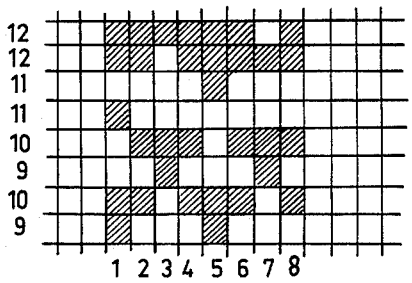
Figure 3:
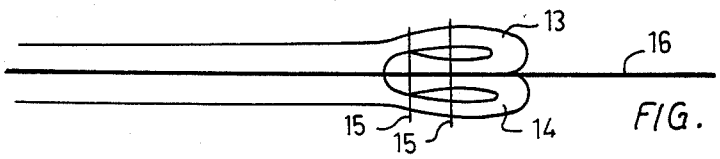
FIG. 3 is a principle view of an edge of the product.

The textile product, for example, a fringed hair yarn mat, shown in the FIGS. 1 to 3 consists of straight supporting warp threads 2, 4, 6, 8 arranged in a planar surface and weft threads 9 to 12 which extend transversally to said supporting warp threads, of which the threads 9, 10 are thicker than the threads 11, 12 and of which the threads 9, 11 are located above the supporting warp thread plane and the threads 10, 12 under this plane. In addition, the product is provided with binding warp threads 1, 5 and 3, 7 which, in a zig-zag form, cross the plane of the supporting warp threads and bind the weft threads 9, 10 to the product.

The edge of the product provided with thin weft threads 11, 12 is made in the following manner. A group of binding warp threads including the threads 1 and 5 is, after having passed around the last lower weft thread 10, divided into two part groups of which one (thread 1) passes over the first upper weft thread 11, hereafter under the next weft thread 11, etc., while the other (thread 5) passes under the first upper weft thread 11, over the next one, etc. In this way, the binding warp threads 1, 5 form in the edge of the product a thin edge strip 13.

The group of binding warp threads 3, 7 is in a corresponding manner divided into two part groups by means of which a second edge strip 14 is formed. The supporting warp threads 2, 4, 6, 8 pass straight through the product between the edge strips ending at a suitable distance from the edge strips. Hereafter the edge strips 13, 14 are, in the manner shown in FIG. 3, folded inwards (or alternatively outwards) and are secured by a double stitch 15. The supporting warp threads 2, 4, 6, 8 then form the fringes 16 of the product.

Figure 4:
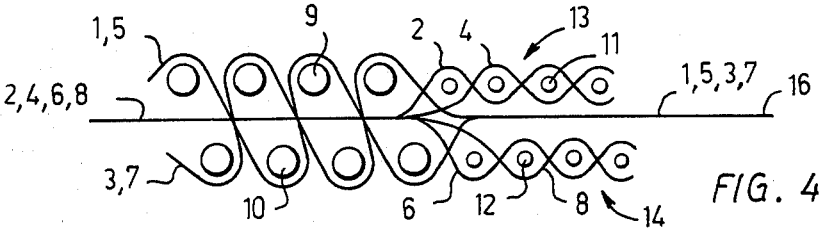
FIG. 4 is a section similar to FIG. 1 of the edge of a second embodiment of the textile product according to the invention.
Figure 5:
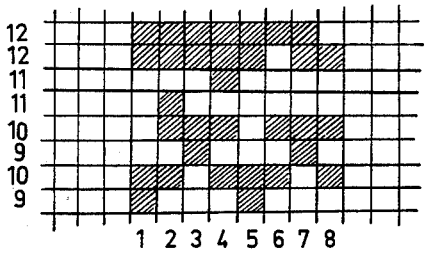
FIG. 5 is a structure view of the product of FIG. 4.
Figure 6:
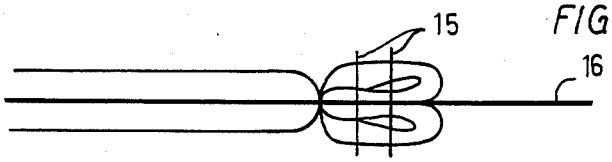
FIG. 6 is a principle view of an edge of the product according to FIG. 4.

The FIGS. 4 to 6 show a second embodiment of the invention. The supporting warp threads 2, 4, 6, 8 of the product are in the edge area divided into four part groups by means of which the edge strips 13, 14 are formed, while all binding warp threads 1, 5 and 3, 7 are in the edge area positioned in the plane of the supporting warp threads while projecting from between the edge strips as fringes 16. Also in this case the edge strips are folded over and sewn by a double stitch 15, due to which the fringes formed by the binding warp threads need not be tied.

What I claim is:

1. A woven textile product having fringes on the edges and, on each side of a plane defined by supporting warp threads, weft threads which are bound to each other by means of binding warp threads crossing said plane, edges of the product being provided with two adjoining edge strips which are folded over to form a selvedge, said edge strips being formed such that in the edge area of the product, a part of the binding warp threads binds the weft threads on one side of said plane defined by the supporting warp threads to each other and the remainder of the binding warp threads binds the weft theads on the opposite side of said plane to each other, the supporting warp threads not included in said edge strips extending between said edge strips beyond said selvedge as fringes.

2. A method for manufacturing a fringed textile product according to which method on each side of a plane defined by straight supporting warp threads are positioned weft threads which are bound together by means of binding warp threads crossing said plane, and edges of the product are provided with two adjoining edge strips which are folded over to form a selvedge, whereby, for forming said edge strips, the weft threads located on one side of said plane defined by supporting warp threads are bound to each other by means of a part of said binding warp threads and the weft threads located on the opposite side of said plane are bound to each other by means of other binding warp threads and the supporting warp threads not included in said edge strips are made to extend between said edge strips to the outside of said selvedge to form the fringes.

* * * * *